US008997418B2

(12) United States Patent
Rice

(10) Patent No.: US 8,997,418 B2
(45) Date of Patent: Apr. 7, 2015

(54) LOAD SUPPORTING BLOCKING MEMBER FOR USE IN A METAL STUD WALL

(71) Applicant: Bailey Metal Products Limited, Concord (CA)

(72) Inventor: John Rice, Aurora (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 13/852,968

(22) Filed: Mar. 28, 2013

(65) Prior Publication Data

US 2014/0290163 A1 Oct. 2, 2014

(51) Int. Cl.
*E04B 1/94* (2006.01)
*E04B 1/24* (2006.01)

(52) U.S. Cl.
CPC ..... *E04B 1/2403* (2013.01); *E04B 2001/2457* (2013.01)

(58) Field of Classification Search
CPC E04B 2002/7485; E04B 2/7457; E04B 2/763
USPC ..... 52/317, 481.1, 655.1, 696, 715
See application file for complete search history.

(56) References Cited

U.S. PATENT DOCUMENTS

| | | | | |
|---|---|---|---|---|
| 1,867,449 | A * | 7/1932 | Eckett | 52/100 |
| 1,931,739 | A * | 10/1933 | Rutten | 52/245 |
| 4,703,593 | A * | 11/1987 | Smolik | 52/34 |
| 5,189,857 | A * | 3/1993 | Herren et al. | 52/317 |
| 6,260,318 | B1 * | 7/2001 | Herren | 52/317 |
| 6,705,056 | B2 * | 3/2004 | Tollenaar | 52/317 |
| 7,025,314 | B1 * | 4/2006 | Thomas et al. | 248/205.1 |
| 7,331,149 | B2 * | 2/2008 | Tollenaar | 52/481.1 |
| 7,520,100 | B1 * | 4/2009 | Herrman et al. | 52/481.1 |
| 2003/0167722 | A1 * | 9/2003 | Klein et al. | 52/653.1 |

* cited by examiner

*Primary Examiner* — Jeanette E Chapman
*Assistant Examiner* — Daniel Kenny

(57) ABSTRACT

The present invention is directed to a load supporting blocking member for use in a metal stud wall having a plurality of parallel spaced apart metal studs, each of the studs having an aligned opening and horizontal bridging member passing through the aligned openings and tying the studs together. The load supporting blocking member comprises a base for overlying and being attached to the bridging member and an upstanding flange extending from one edge of the base the depth of the base being sufficient to overly the bridging member and position the upstanding flange in line with the edges of the studs in the metal stud wall.

3 Claims, 11 Drawing Sheets

30
14
30
32
18
36
62
62
24
34

LOAD SUPPORTING BLOCKING MEMBER FOR USE IN A METAL STUD WALL

FIELD OF THE INVENTION

The present invention relates to a load supporting blocking member for use in a metal stud wall to transfer load from an object mounted on the surface of the wall to the metal studs.

BACKGROUND OF THE INVENTION

It is common practice in both commercial and residential buildings to separate and define rooms using partition walls. In most commercial buildings, these walls are typically constructed of metal studs. The metal stud wall typically has a top track located horizontally at ceiling level, a bottom track located horizontally along the floor and vertically parallel stud members spaced evenly throughout the length of the wall secured between the top track and bottom track. Typically for non-loading bearing interior partition walls, the studs and tracks are constructed of 22 to 26 gauge steel which provides for sufficient structure to support the drywall mounted to the outside of the stud wall. For load bearing walls, either walls where the wall is required to carry a load of the ceiling and room structure or where it is desired to install fixtures such as hand rails, cabinets, or other fixtures, the studs and track are typically made from a heavier gauge steel such as 16 to 20 gauge. Such walls constructed of the heavier gauge steel are more expensive both in terms of the cost of the steel from which the studs and track are manufactured as well as in the time required to handle the heavier gauge member and to construct the wall, as such walls require heavier duty fastening systems and owing to the thickness of the metal require more time to install the fastenings compared to the lighter gauge non-loading bearing members. Heavier gauge metal also has the drawback of having better sound transmission and requires more layers of wallboard to maintain the desired reduced sound transmission properties.

Typically when a fixture such as a cabinet or handrail is to be mounted to the wall, the wall is constructed utilizing the heavier gauge load supporting members and a metal strip of a 16 to 20 gauge metal is installed horizontally along the wall at the position where the fixture is to be mounted. The drywall is then mounted to the wall in the usual manner and after finishing, the fixture is mounted to the metal strip to transfer the load of the fixture through the metal strip to the studs of the wall.

It would be desirable to provide for a load supporting blocking member for use in a light gauge metal stud wall which would allow for proper support for fixtures while reducing the cost of constructing the wall through the use of the lighter gauge materials and less layers of wallboard.

SUMMARY OF THE INVENTION

The present invention is directed to a load supporting blocking member for use in a metal stud wall having a plurality of parallel spaced apart metal studs, each of the studs having an aligned opening and a horizontal bridging member passing through the aligned openings and tying the studs together. The load supporting blocking member comprises a base for overlying and being attached to the bridging member and an upstanding flange extending from one edge of the base, the depth of the base being sufficient to overly the bridging member and position the upstanding flange in line with the edges of the studs in the metal stud wall.

In an aspect of the invention, the base of the blocking member is provided with a downwardly extending tab at the opposite edge from the upstanding flange to butt against the side of the bridging member and properly position the blocking member within the wall cavity.

In another aspect of the invention, the base of the blocking member is provided with cut outs adjacent to the upstanding flange to allow for passage of wiring, plumbing and other services through the base.

BRIEF DESCRIPTION OF THE DRAWINGS

Preferred embodiments of the present invention are illustrated in the attached drawings in which.

DETAILED DESCRIPTION OF THE PREFERRED EMBODIMENTS

Figure 1:
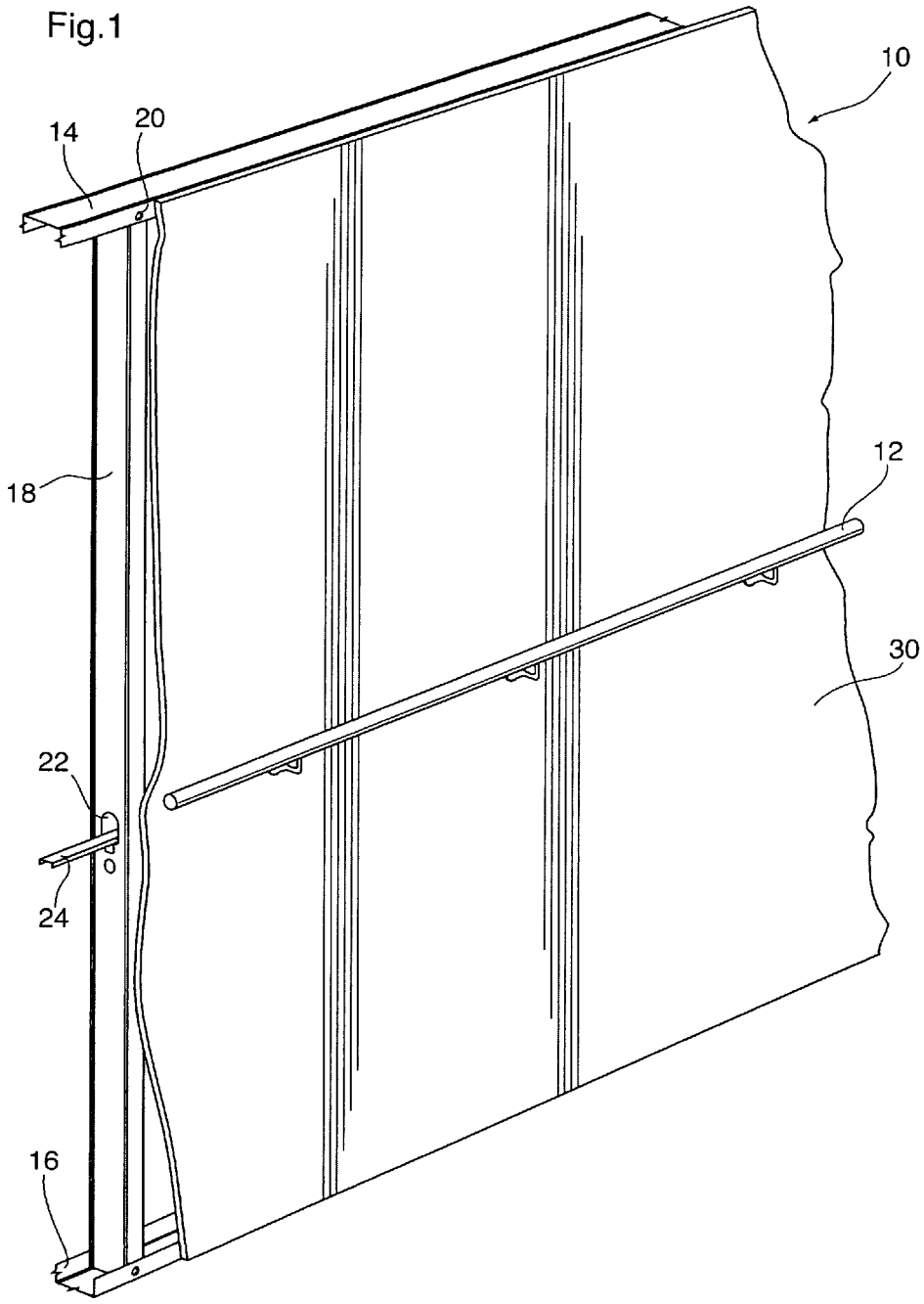
FIG. 1 is a perspective view of a wall having a hand rail supported by the blocking members of the present invention.

FIG. 1 illustrates a metal stud wall constructed utilizing a preferred embodiment of a blocking member of the present invention to support a fixture such as a hand rail attached to the wall. The metal stud wall 10 is constructed of a top track 14 attached to a ceiling and a bottom track 16 attached to the floor. A plurality of metal studs 18 are installed vertically within the top track 14 and bottom track 16 evenly spaced along the wall 10. The spacing of the studs is typically 16 or 24" on center. The studs 18 are attached to the top track 14 and bottom track 16 through the use of suitable fasteners 20. The studs 18 are provided with a first opening 22 which allows for a bridging member 24 to be passed through the opening and attached to the web of the stud 18 by friction fit to provide axial support for the studs 18. A second opening 28 may also be provided in the stud for the passage of services such as wiring or plumbing through the studs within the wall. While the drawings only show one set of first 22 and second 28 openings, it is common in the art to provide sets of such openings at regularly spaced interval along the web of the stud, typically 24 to 36 inches apart. The surface of the wall 10 is provided with a wall covering 30 such as drywall to provide for a finished appearance to the wall 10. The wall covering or drywall 30 is attached to the studs through the use of suitable fasteners 32.

Figure 2:
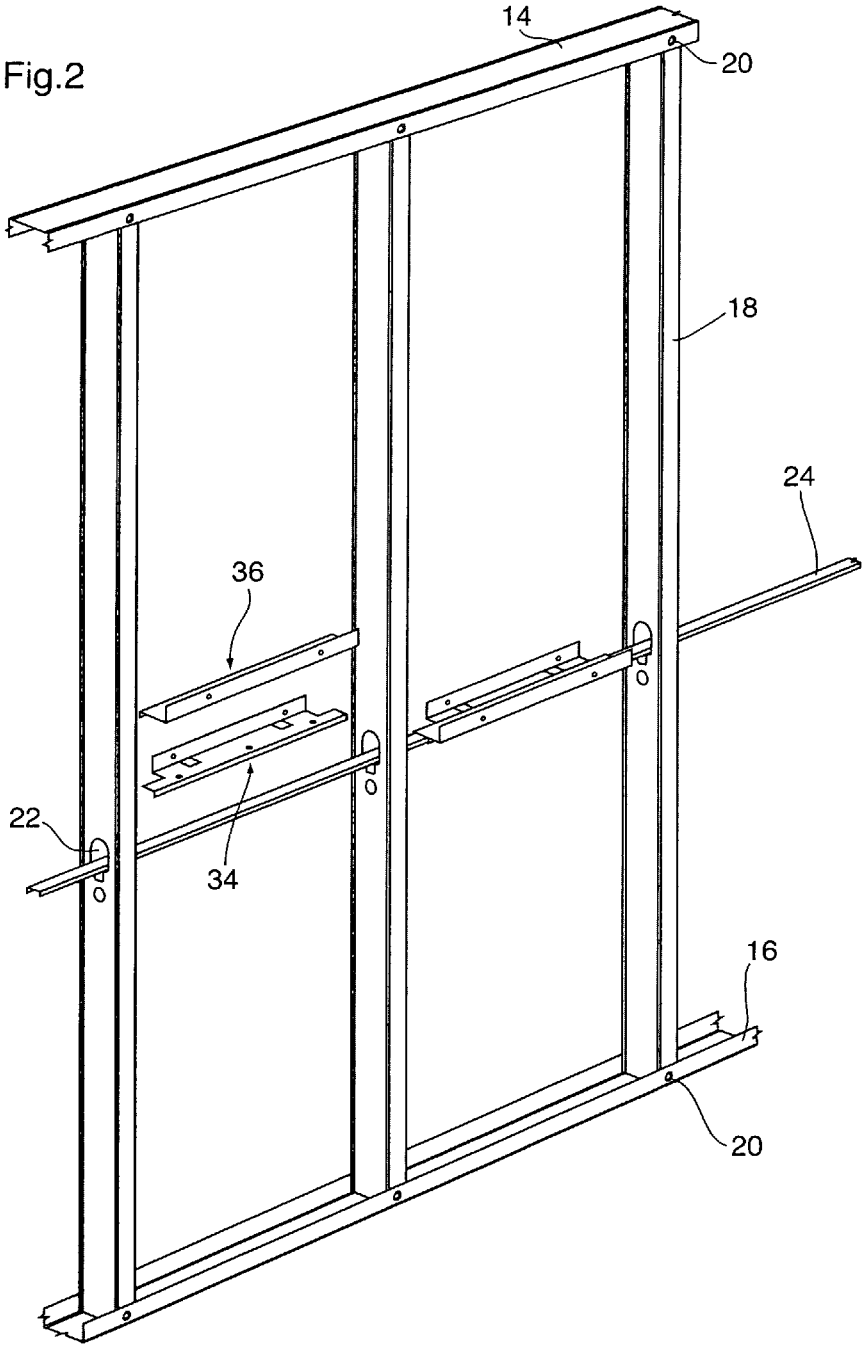
FIG. 2 is a perspective view of a section of a wall illustrating the positioning of the blocking members of the present invention.
Figure 3:
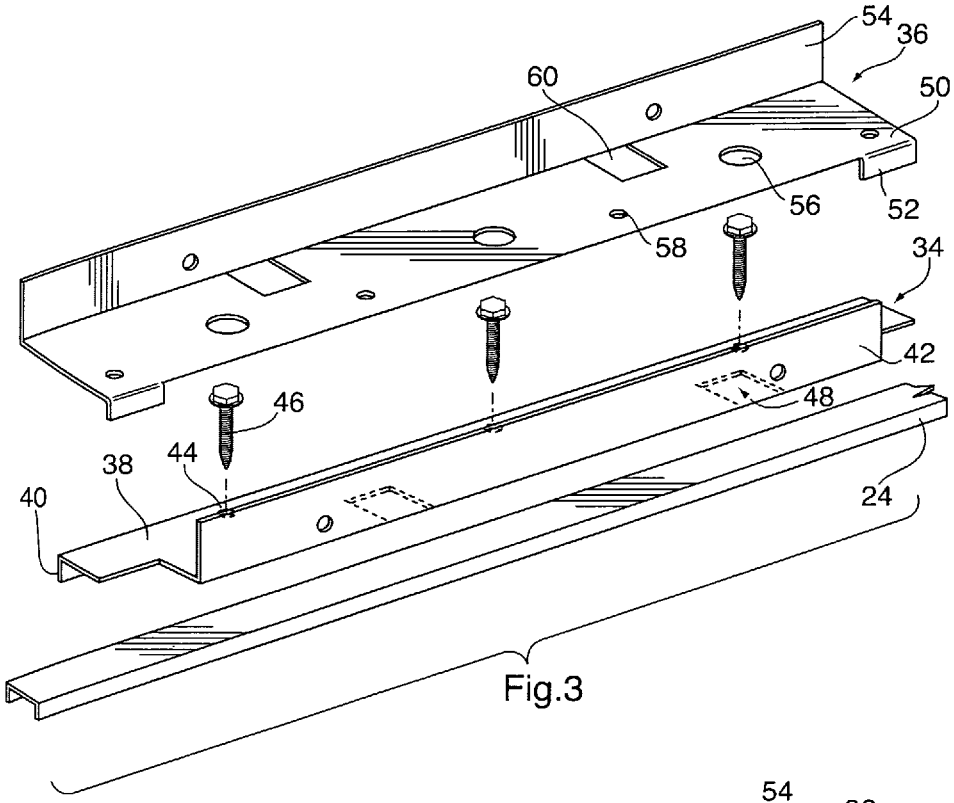
FIG. 3 is an exploded perspective view of the blocking members being attached to a bridging member.
Figure 4:
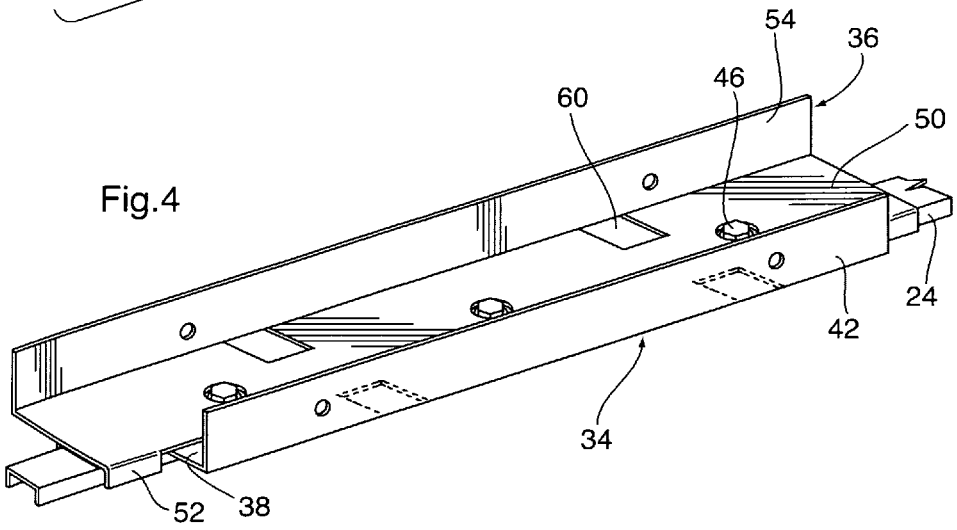
FIG. 4 is a perspective view of the blocking members of the present invention attached to a bridging member of a metal stud wall.
Figure 5:
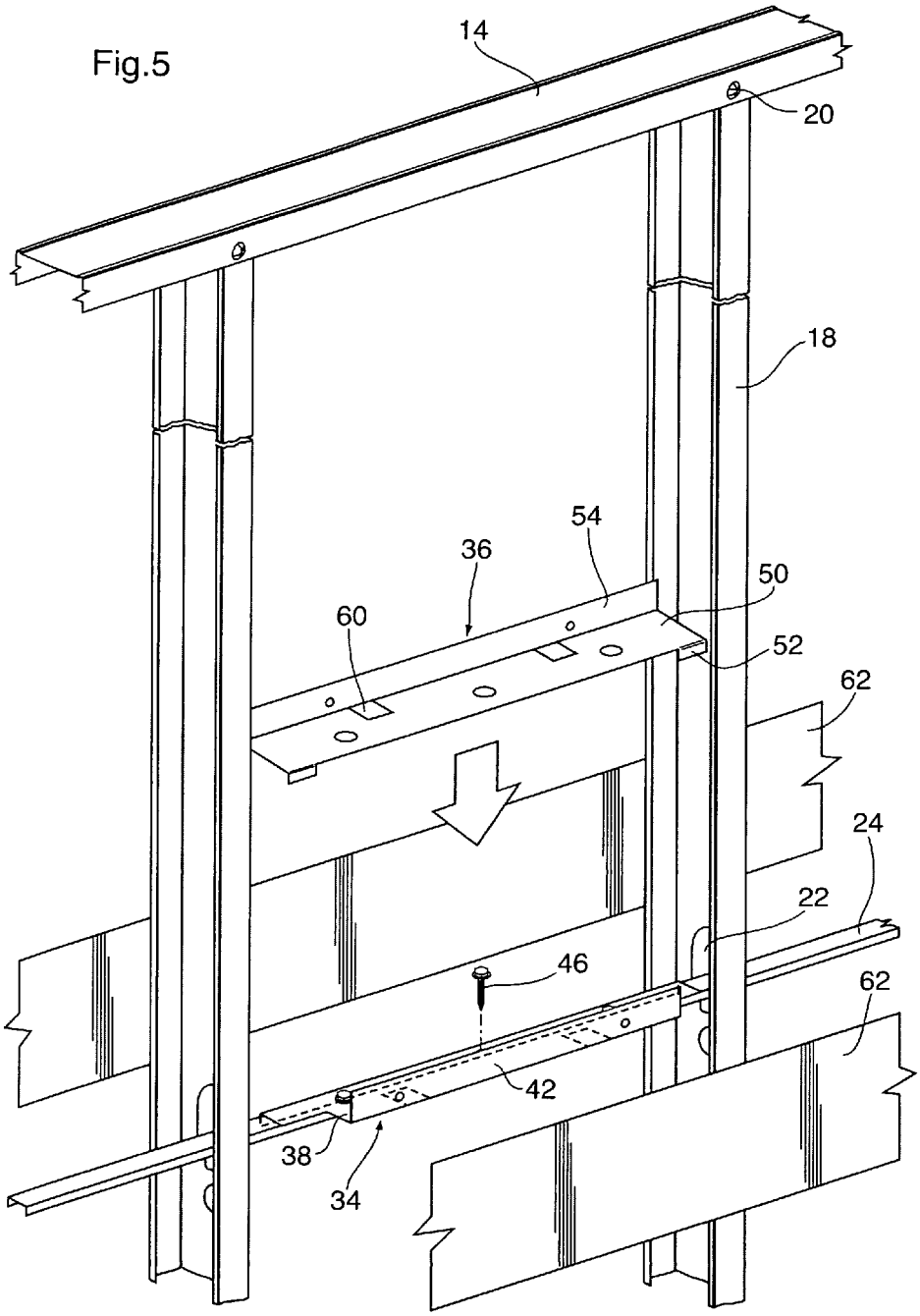
FIG. 5 is a perspective view of the blocking members of the present invention being attached to a section of a metal stud wall.
Figure 6:
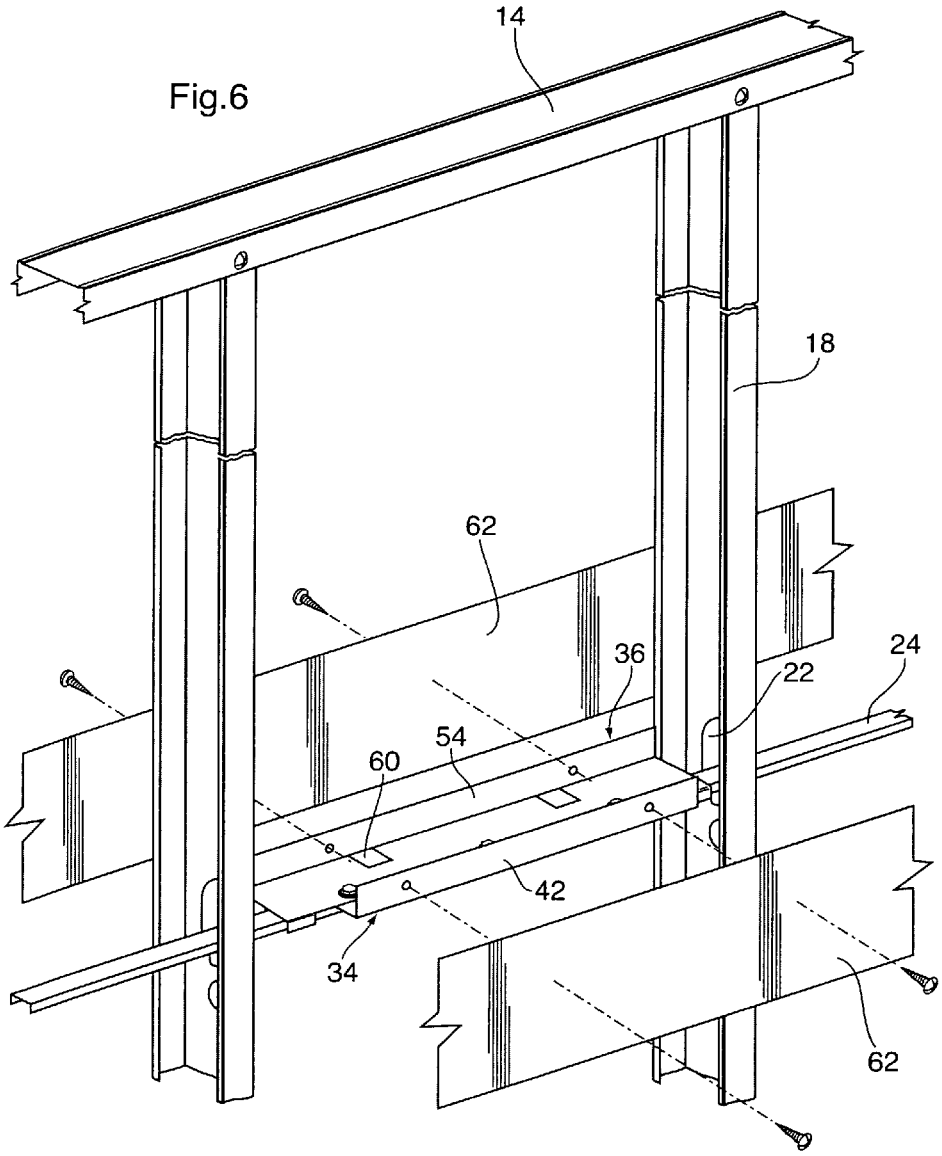
FIG. 6 is a perspective view of the metal panels being attached to the blocking member of the present invention.
Figure 7:
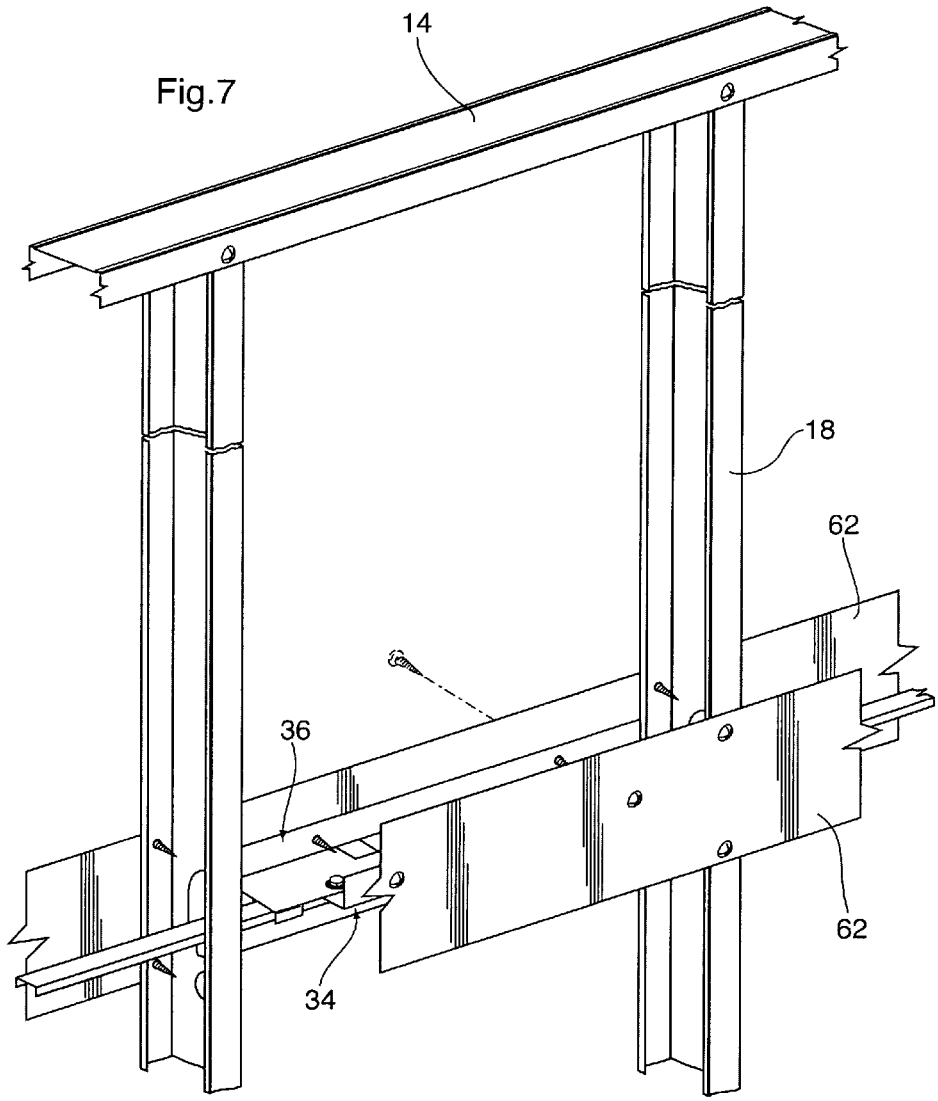
FIG. 7 is a perspective view of the metal panels being attached to the wall section.
Figure 8:
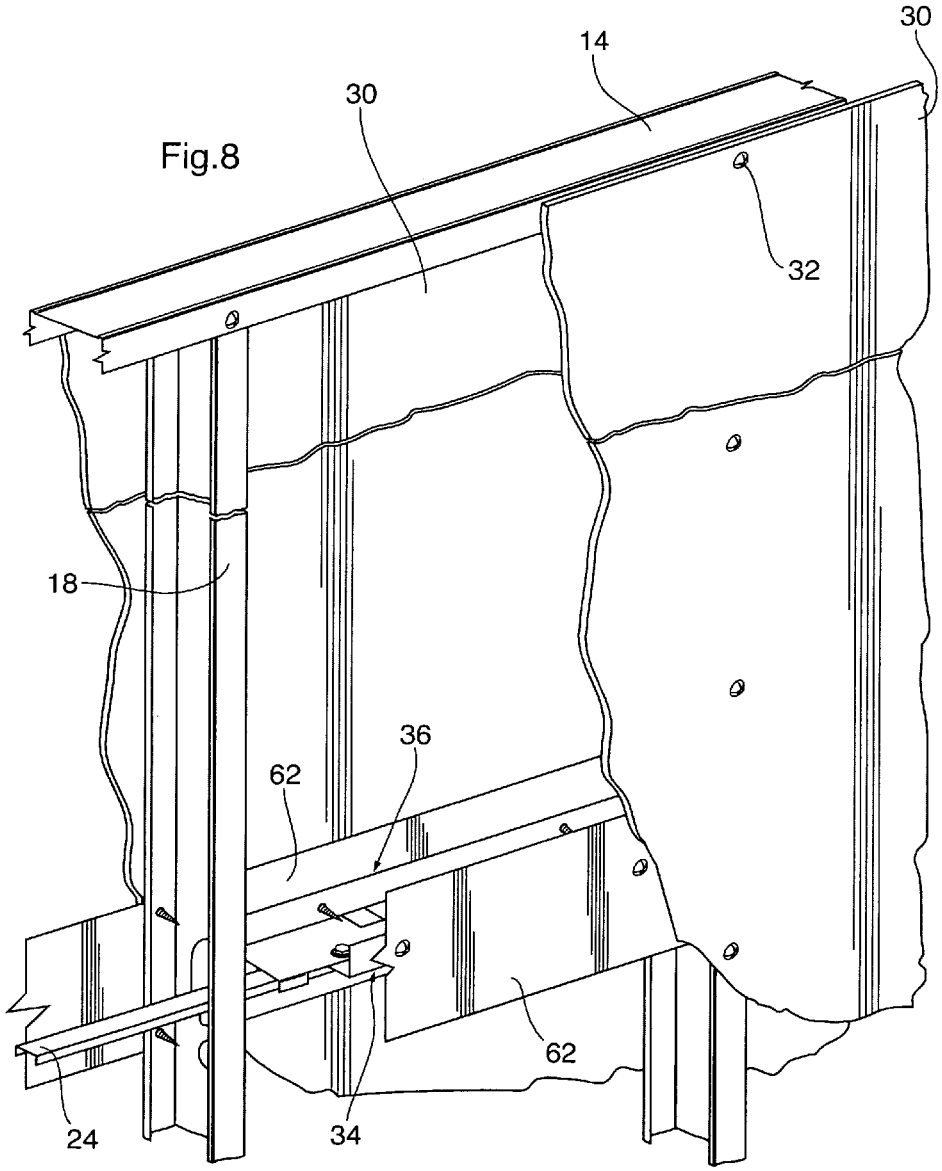
FIG. 8 is a perspective view of the wall section having the blocking member of the present invention attached thereto.
Figure 9:
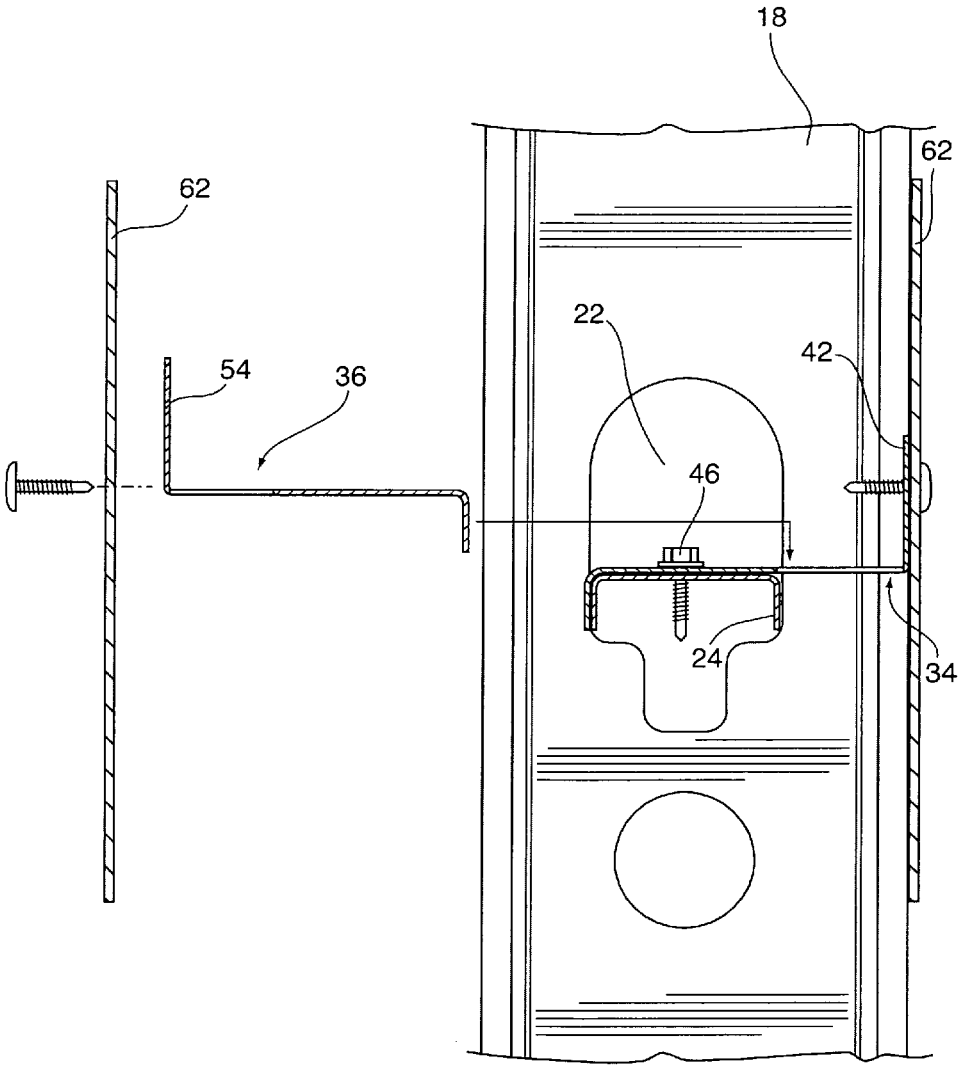
FIG. 9 is a side elevation view in cross section of the blocking member being attached to the bridging member.
Figure 10:
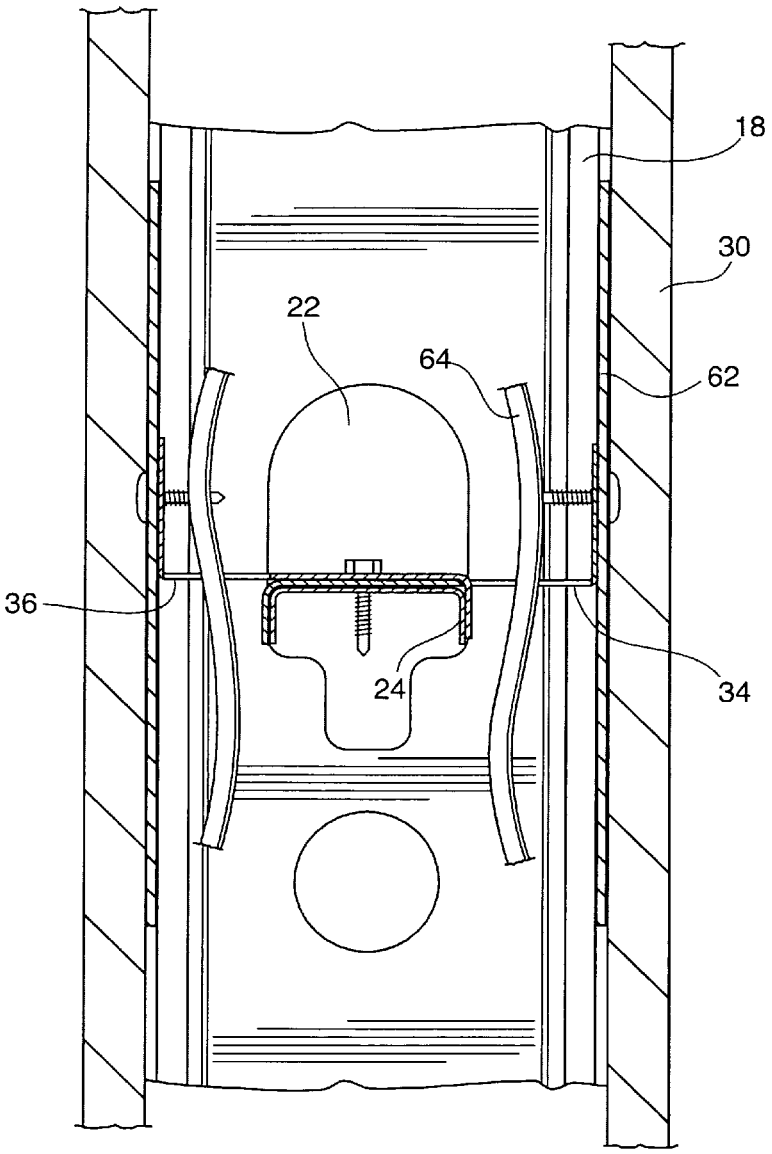
FIG. 10 is a side elevation view in cross section of the wall with the blocking members attached thereto illustrating the passage of the services through the blocking member.

FIGS. 2 through 4 illustrate a preferred embodiment of the load supporting blocking member of the present invention and the method for installing it within the metal stud wall. Blocking member 34 is utilized when it is necessary only to provide the support of one side of the stud wall. If support on both sides of the stud wall is required, then a second blocking member 36 is utilized to overlay the first blocking member 34. Blocking member 34 has a base 38 of a depth sufficient to overlay the bridging member 24 and extend to the edges of the metal studs 18. In order to provide for proper positioning of the blocking member 34, a downwardly extending tab or lip 40 is provided along one edge of the base 38, the downwardly extending lip or tab 40 butting against the edge of the bridging member 24 for the proper positioning of the blocking support member 34. The edge of the base 38 of the blocking support member 34 is provided with an upstanding tab extending upwardly perpendicularly from the base 38 to which metal panels, as will be described below, may be attached. As the blocking support member 34 is preferably constructed of a heavy gauge steel such as 14 to 18 gauge metal, it is preferred if pilot holes 44 are provided in the base 38 for attachment of the blocking support member 34 to the bridging member 24 utilizing fasteners 46 preferably self-tabbing fasteners. The provision of the pilot holes 44 allows for the fasteners to be more easily inserted through the base 38 and into the bridging member 24.

As it is common that various services such as electric, telephone, data, plumbing, etc. are fed through the wall cavities particularly in an institutional environment such as a hospital or clinic, it is preferred if cutouts 48 are provided in the base 38 to allow for passage of such services through the base.

When it is desired to provide support for fixtures on both sides of the wall 10 a second blocking support member 36 is provided which will overly the first blocking support member 34 attached to the bridging member 24. Similar to the first blocking support member 34, blocking support member 36 has a base 50 with downwardly extending tabs 52 at one edge of the base 50 and an upstanding tab 54 at the opposite edge of the base 50. In order to allow the second blocking support member 36 to properly overly the first blocking support member 34, the downwardly extending tabs 52 are provided at the outside edges of the base 50 with a space therebetween to accommodate the upstanding tab 42 of the first blocking member. In order to provide for uniform thickness of the metal for the two blocking support members 34 and 36, the base 38 of the first blocking support member 34 extends outwardly in the region overlying the bridging member 24 such that the length of the base 38 in, this region is the same as the length of the base 50 of the second blocking support member 36. The open area behind this portion of the base 38 extending to the upstanding tab 42 allows for the downward tabs 52 of the second blocking support member 36 to be accommodated. The base 50 of the second blocking support member 36 is also provided with opening 56 to accommodate the heads of the fasteners 46 utilized to attach the first blocking support member 44 to the bridging member 24. In this way, the bases 38 and 50 of the blocking support members 34 and 36 lie one on top of the other with no spacing therebetween. Similar to the first blocking support member 34, the base 50 of the second blocking support member 36 is provided with pilot holes 58 for fasteners 46 to attach the blocking support member 36 to the first blocking support member 34 and the underlying bridging member 24. Also similar to the first blocking support member 34, the second blocking support member 36 is provided with cutouts 60 to accommodate wiring and other services.

A method of installing and using a blocking support member of the present invention is illustrated in FIGS. 5 through 10. The stud wall 10 is constructed in the usual manner by attaching a top track 14 to the ceiling and the bottom track 16 to the floor. The studs 18 are then placed within the track at the desired spacing typically 16 inches on center and fastened to the top track 14 and bottom track 16 through the use of fasteners 20. Bridging members 24 are then installed within the studs 18 by passing through the first openings 22 and then attached to the web of the stud through friction fit. The first blocking support member 34 is then installed within the space between two adjacent studs 18 by laying the blocking support member 34 on top of the bridging member 24 such that the downwardly extending tab or lip 40 butts up against the side of the bridging member 24. Fasteners 46 are then utilized to attach the first blocking support member 34 to the bridging member 24 utilizing the pilot holes 44. If it is desired to have load bearing support on both sides of the stud wall 10, then second blocking support member 36 is placed on top of the first blocking support member 34 with the fasteners 46 attaching the first blocking support member 34 passing through the openings 56 in the base 50 of the second blocking support member. The downward tabs 52 are contained within the opening area adjacent the upstanding tab 42 of the first blocking support member 34 until they butt against the side of the bridging member 24, the second blocking support member 36 is then attached to the first blocking support member 34 and bridging member using the fasteners 46. Metal strips 62 are then attached to the stud wall in the area where the blocking support members 34 and 36 are located. The metal strips 62 are attached to the flanges of the studs 18 as well as to the upstanding tabs 42 or 54 of the first blocking support member 34 or second blocking support member 36. In this way, the load of any fixtures attached to the wall and in particular to the metal strips is carried through the blocking support members to the bridging member 24 and then distributed along the length of the wall 10.

Once the metal strips 62 have been attached services such as wiring 64 is installed within the wall cavity. If the wiring is required to pass through the blocking support members 34 or 36, it may be fed through the cutouts 48 or 60 of the respective blocking support members. Once all the services are installed, then the wall covering material such as drywall 30 is installed to the wall in the usual manner using drywall fasteners 32.

Figure 11:
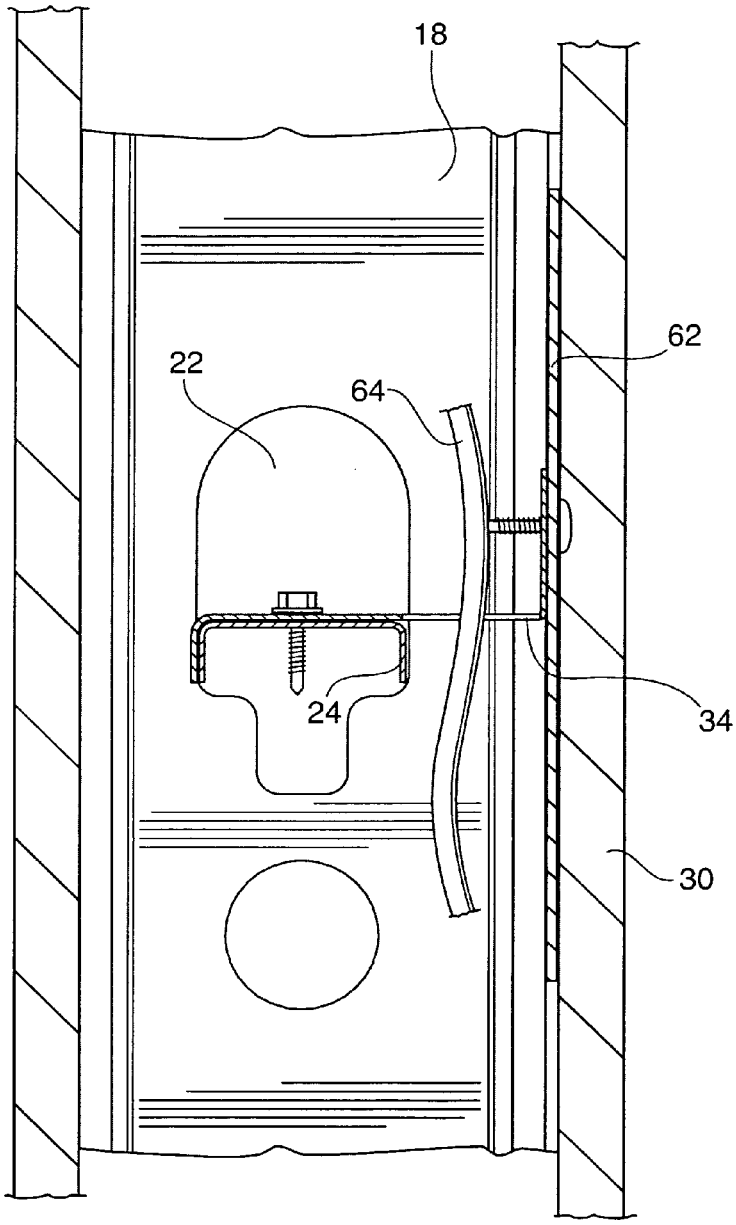
FIG. 11 is a section of a wall where the blocking member and metal panel are provided on only one side of the wall.

As noted above, there may be situations where it is necessary to provide the load supporting structure on only one side of the wall. In such a situation, typically only the first blocking support member 34 is utilized. Such a set up is illustrated in FIG. 11 showing the blocking support member 34 attached to the bridging member 24 and the metal strip attached to the blocking support member upstanding tab 1.

Figure 12:
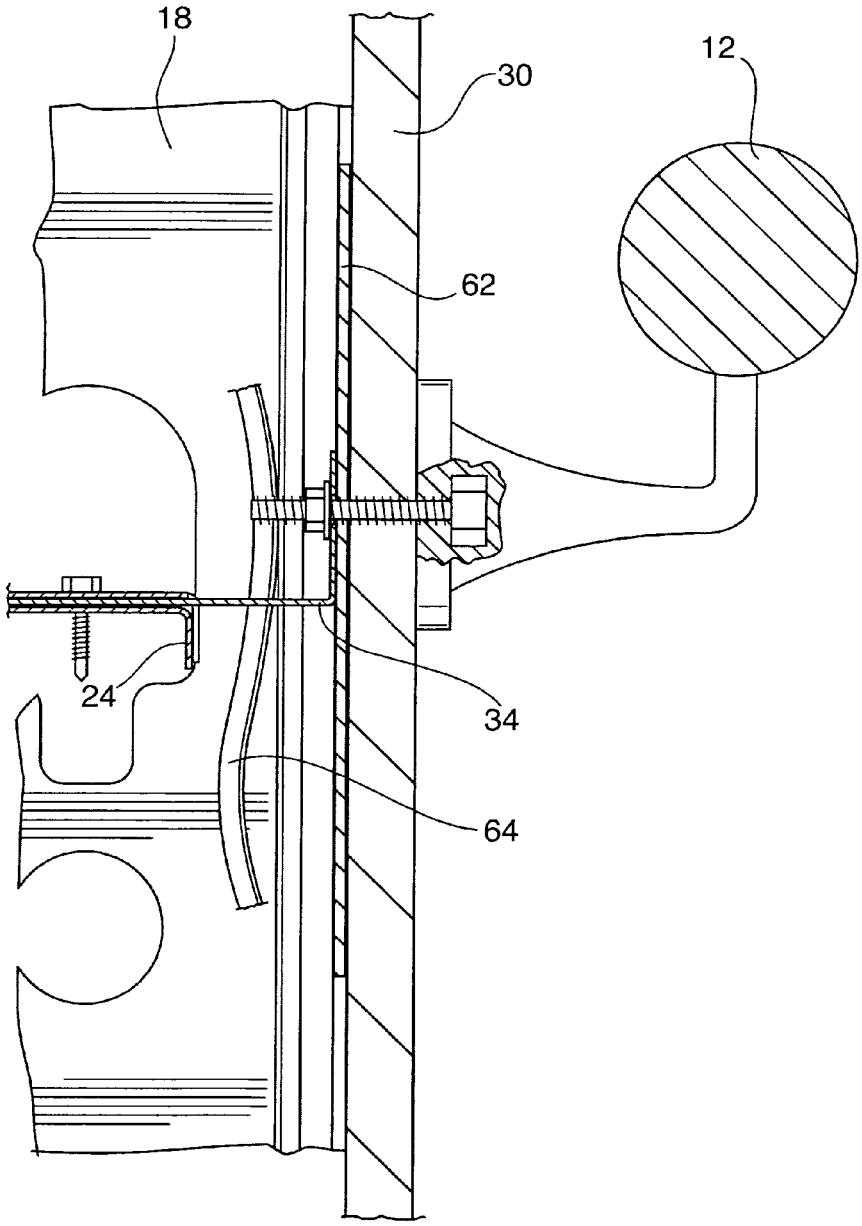
FIG. 12 is a side elevation and cross section illustrating the attachment of a hand rail to the wall utilizing the blocking member of the present invention.

FIG. 12 illustrates in cross section one use of the system of the present invention for carrying the load of a handrail for example. The handrail is attached to the wall 10 by suitable fasteners which pass through the wall into the metal strip and the upstanding tab 42 or 54 of the blocking support members 34 or 36. In this way, the load from the handrail is transferred through the blocking support member to the bridging member 24 and thereafter throughout the length of the wall.

The load supporting blocking member of the present invention allows for the support of fixtures attached to metal stud walls constructed of lighter gauge metal, such as 25 gauge.

The use of the lighter gauge metal results in significant savings, both in terms of material and labor costs associated with the construction of the metal stud wall as well as requiring less wallboard to achieve desired STC values.

Although various preferred embodiments of the present invention have been described herein in detail, it would be appreciated by those skilled in the art that variations may be made thereto without departing from the spirit of the invention or the scope of the appended claims.

The embodiments of the invention in which an exclusive property or privilege is claimed are defined as follows:

1. A metal stud wall comprising a plurality of vertically arranged spaced apart metal studs, the metal studs being interconnected at the top and bottom by top and bottom plates respectively, each of the studs being generally C shaped with spaced apart flanges for orientation to the interior and exterior of a space the metal stud wall is dividing, the flanges being connected by a central web therebetween, the central web of each of the studs being provided with an opening having a width less than the width of the web of the stud through which a horizontal bridging member passes to tie the studs together and a load supporting blocking member comprising a base overlying and attached to the bridging member and an upstanding flange extending from one edge of the base in line with the flanges of the studs in the metal stud wall.

2. A metal stud wall according to claim 1 wherein the base of the blocking member is provided with a downwardly extending tab at the opposite edge from the upstanding flange to butt against the side of the bridging member and properly position the blocking member within the wall cavity.

3. A metal stud wall according to claim 2 wherein the base of the bridging member is provided with cut outs adjacent to the upstanding flange to allow for passage of wiring, plumbing and other services through the base.

* * * * *